US011547154B2

(12) United States Patent
Wood

(10) Patent No.: US 11,547,154 B2
(45) Date of Patent: Jan. 10, 2023

(54) ASPHYXIATION-SAFE ADJUSTABLE BIB WITH PLACEMAT

(71) Applicant: Zak Wood, Sammamish, WA (US)

(72) Inventor: Zak Wood, Sammamish, WA (US)

( * ) Notice: Subject to any disclaimer, the term of this patent is extended or adjusted under 35 U.S.C. 154(b) by 0 days.

(21) Appl. No.: 17/246,318

(22) Filed: Apr. 30, 2021

(65) Prior Publication Data

US 2022/0346464 A1 Nov. 3, 2022

(51) Int. Cl.
*A41B 13/10* (2006.01)
*A47G 23/03* (2006.01)

(52) U.S. Cl.
CPC ..... *A41B 13/103* (2013.01); *A47G 23/0303* (2013.01)

(58) Field of Classification Search
CPC ..... A41B 13/103; A41B 13/106; A41B 13/10; A47G 2023/0675; A47G 23/0303; A47G 23/0633
See application file for complete search history.

(56) References Cited

U.S. PATENT DOCUMENTS 453,490 A * 6/1891 Kropp ..... A41B 13/103 433/136
2,105,029 A * 1/1938 Doty ..... A41B 13/106 2/49.5
2,643,384 A * 6/1953 Thompson ..... A41B 13/106 2/49.3
2,762,053 A * 9/1956 Lipscomb ..... A41B 13/106 2/49.5
2,766,455 A * 10/1956 Klaine ..... A47D 1/008 2/49.5
4,301,544 A * 11/1981 Burton ..... A41B 13/106 2/49.5
5,056,159 A 10/1991 Zemke, Jr.
5,107,545 A * 4/1992 Potter ..... A41D 13/0012 2/48
D338,319 S * 8/1993 Bickel ..... D7/505
5,778,450 A * 7/1998 Hagestad ..... A47G 23/0608 2/49.3
5,829,627 A * 11/1998 Martindale ..... A47G 23/0303 220/666
5,850,956 A * 12/1998 Hayward, Jr. ..... A45F 5/00 220/737

(Continued)

FOREIGN PATENT DOCUMENTS

DE 593554 C * 2/1934
GB 533656 A * 2/1941

(Continued)

*Primary Examiner* — Heather Mangine

(57) ABSTRACT

An asphyxiation-safe adjustable bib and placemat provides a bib having a rear surface that supports a bib retainer in one of a plurality of positions so a length of the bib can be adjusted to accommodate a height of a wearer. The bib retainer and a portion of the bib adjacent the bib retainer are inserted into a bib retainer channel of the placemat to secure the bib to the placemat. The bib retainer in the bib retainer channel resists movement of the bib away from the placemat but enables forceful movement of the bib away from the placemat to protect against injury due to asphyxiation if the wearer slips or falls from a chair while using the bib and placemat.

20 Claims, 12 Drawing Sheets

(56) References Cited

U.S. PATENT DOCUMENTS 5,960,472 A * 10/1999 Reid ..... A41D 13/04 2/48
6,000,056 A * 12/1999 Brady ..... A41B 13/103 2/49.1
6,021,521 A * 2/2000 Baratta ..... A47G 23/06 2/49.1
6,081,923 A * 7/2000 Marks ..... A41B 13/106 2/49.3
6,128,781 A * 10/2000 Spindler ..... A41B 13/106 2/49.3
6,581,210 B2 6/2003 Kaloustain
7,469,425 B2 * 12/2008 DeStefano ..... A41B 13/106 2/49.3
8,151,370 B2 * 4/2012 Perazzo ..... A41B 13/103 2/49.3
8,388,403 B2 * 3/2013 Seter ..... A47G 19/10 108/26
8,820,548 B2 * 9/2014 Wilson ..... A47B 13/14 248/229.15
8,851,370 B2 10/2014 DiMuro
9,462,903 B2 10/2016 Laurain
10,674,850 B2 6/2020 Fynbo et al.
2002/0004945 A1 * 1/2002 Kaloustian ..... A41B 13/106 2/49.3
2004/0205876 A1 * 10/2004 Bruffett ..... A41B 13/103 2/49.2
2004/0245146 A1 * 12/2004 Kulp, III ..... A41B 13/106 206/557
2010/0088796 A1 * 4/2010 Perazzo ..... A41B 13/106 2/48
2010/0176626 A1 * 7/2010 Centracco ..... A47D 1/006 2/49.3
2011/0174677 A1 * 7/2011 Blondeel ..... A47G 19/06 264/319
2013/0086725 A1 * 4/2013 Sabre ..... A41B 13/106 2/49.1
2013/0161984 A1 * 6/2013 Yaghmai ..... A41B 13/106 2/49.3
2014/0173600 A1 6/2014 Wulf et al.
2014/0173800 A1 * 6/2014 Wulf ..... A41B 13/106 2/49.3
2015/0173434 A1 6/2015 Sabre
2015/0272229 A1 * 10/2015 Lu ..... A41B 13/103 2/49.2
2016/0073805 A1 * 3/2016 Laurain ..... A47G 19/02 220/574
2018/0220715 A1 8/2018 Bisson et al.
2018/0271179 A1 * 9/2018 Sellers ..... A41B 13/106
2018/0368594 A1 * 12/2018 Hakim ..... A47G 23/0303
2019/0174838 A1 * 6/2019 D'Amato-Friedman ..... A41B 13/103
2020/0138120 A1 * 5/2020 Brazdo ..... A41B 13/10
2020/0178716 A1 * 6/2020 Fynbo ..... F16B 47/00
2020/0268185 A1 * 8/2020 Koenig ..... A47G 23/0303
2021/0345806 A1 * 11/2021 Rowe ..... A47G 23/0225

FOREIGN PATENT DOCUMENTS

GB 613048 A * 11/1948
WO WO-2020060458 A1 * 3/2020

* cited by examiner

ASPHYXIATION-SAFE ADJUSTABLE BIB WITH PLACEMAT

RELATED APPLICATIONS

This is the first application filed for this invention.

FIELD OF THE INVENTION

This invention relates in general to apparatus for serving food and catching food spillage and, in particular, to an asphyxiation-safe adjustable bib and placemat combination particularly useful for feeding babies and elderly people.

BACKGROUND OF THE INVENTION

Many different placemats for feeding babies and/or the elderly or physically challenged are commercially available. Placemats of this type may be a plain placemat or a placemat with an integral food dish. Both types are typically molded from a silicone rubber formulation or the like to eliminate breakage and promote adhesion to a smooth flat surface. The silicone material tends to cling to smooth surfaces, which makes it difficult for a wearer to pick up the placemat or push it off a table or high-chair tray.

Many different bibs designed to catch and retain food spillage are also known and commercially available, some of which connect directly or indirectly to a tray, placemat or dish of some sort. However, there is no known bib and placemat combination that provides a convenient system that is useful over an extended time, is easy to clean, clings to a flat surface and securely connects the bib to the placemat to contain food spillage while ensuring that the bib will readily detach from the placemat if a user slips from a chair while wearing the bib. There therefore exists a need for a bib with a placemat that meets each of these criteria.

SUMMARY OF THE INVENTION

It is therefore an object of the invention to provide versatile and useful asphyxiation-safe adjustable bib with a placemat.

The invention therefore provides an asphyxiation-safe adjustable bib with placemat, comprising in combination: a placemat having a front bib securement structure and a rear bib securement structure on opposite sides of a bib retainer channel; and a bib having a bib retainer removably affixed to a rear surface thereof, the bib retainer being adapted to be received and retained, along with a portion of the bib adjacent the bib retainer, in the bib retainer channel and to resist movement of the bib to dislodge the bib and the bib retainer from the bib retainer channel.

The invention further provides an asphyxiation-safe adjustable bib with placemat, comprising in combination: a placemat having a flat top surface with a peripheral rim, a front bib securement structure spaced from the peripheral rim and a rear bib securement structure integral with the peripheral rim, and a bib retainer channel between the front bib securement structure and the rear bib securement structure; and a bib having a bib retainer with a rigid central core removably affixed in one of a plurality of parallel positions on a rear surface thereof, the bib retainer being adapted to be received and retained, along with a portion of the bib adjacent the bib retainer, in the bib retainer channel and to resist movement of the bib to dislodge the portion of the bib and the bib retainer from the bib retainer channel, but yield to forceful movement of the bib to release the bib and the bib retainer from the bib retainer channel.

The invention yet further provides an asphyxiation-safe adjustable bib with placemat, comprising in combination: a placemat having a flat top surface with a peripheral rim, a front bib securement structure spaced from the peripheral rim and a rear bib securement structure integral with the peripheral rim and a bib retainer channel between the front bib securement structure and the rear bib securement structure; and a bib having a bib retainer with a rigid central core removably affixed in one of a plurality of parallel locations on a rear surface thereof to permit a length of the bib to be adjusted to accommodate a height of a bib wearer, the bib retainer being adapted to be received, along with a portion of the bib adjacent the bib retainer, in the bib retainer channel and to resist movement of the bib to dislodge the bib and the bib retainer from the bib retainer channel, but yield to forceful movement of the bib to release the bib and the bib retainer from the bib retainer channel.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a bib and placemat useful for feeding an infant and any other person who lacks the coordination required to reliably deliver food from a serving receptacle to their mouth. The placemat may include an integral serving dish, for example a bowl. In one embodiment the placemat is molded from a pliable food-grade material, such as food-grade silicon rubber formulation. One side of the placemat includes a bib retainer channel adapted to receive and retain a bib retainer secured in one of a plurality of spaced-apart locations on a backside of the bib. In one embodiment the bib retainer is received in one of a plurality of parallel pockets provided on a rear side of the bib. In another embodiment the bib retainer is connected to one pair of a plurality of pairs of connectors provided on the rear side of the bib. The bib retainer channel is designed to secure the bib against normal movement of the bib in any direction away from the placemat. This is achieved by providing flexible ends on each side of a bib retainer. The bib retainer releases from the bib retainer channel if a wearer pulls the bib with significant force in any direction away from the placement, such as the force applied to the bib if a wearer slips from a chair or the like.

| Part No. | Part Description |
|---|---|
| 10 | Bib with bib retainer and placemat |
| 12a-d | Bib embodiments |
| 12f | Bib front side |
| 12r | Bib rear side |
| 14a-c | Bib retainer embodiments |
| 16a-d | Placemat embodiments |
| 18 | Bib retainer channel |
| 20 | Placemat flat top surface |
| 22 | Bib neck strap |
| 24a | Bib neck strap connector end |
| 24b | Bib neck strap connector part |
| 24c | Bib neck strap connector second part |
| 26 | Bib retainer rigid core |
| 28a, 28b | Bib retainer flexible ends |
| 30 | Bib retainer pockets |
| 32 | Bib garment sleeves |
| 36, 36 | Bib retainer hook and loop fastener ends |
| 38 | Bib retainer perimeter |
| 40 | Bib hook and loop fastener attachments |
| 44 | Bib attachment snap fastener halves |
| 46 | Bib snap fastener halves |
| 48 | Table |
| 50 | Front bib securement structure |
| 52 | Rear bib securement structure |
| 54 | Placemat food receptacle |
| 56a, 56b | Placemat suction buttons |
| 58a, 58b | Placemat suction cups |
| 60 | Placemat rim |
| 62 | Bib retainer magnet |

Figure 1:
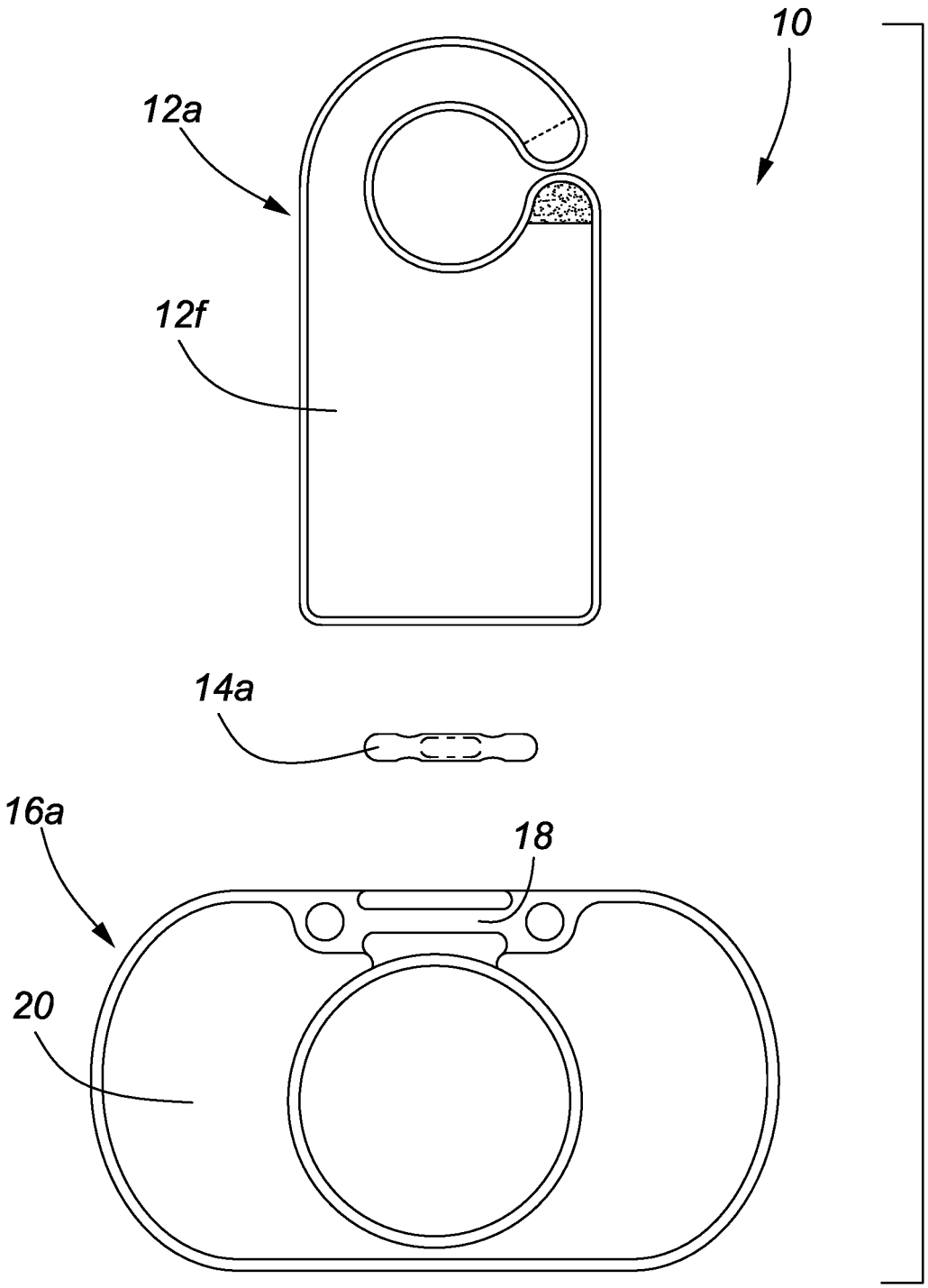
FIG. 1 is an orthographic view of one embodiment of an asphyxiation-safe adjustable bib with one embodiment of a placemat in accordance with the invention.

FIG. 1 is an orthographic view of a bib and bib retainer with placemat 10 in accordance with one embodiment of the invention. The bib and bib retainer with placemat 10 includes a bib 12*a* having a front surface 12*f*, a bib retainer 14*a* and a placemat 16*a* having a bib retainer channel 18. The bib retainer 14*a* is releasably connected to a rear surface of the bib 12*a*, as will be explained below with reference to FIGS. 2B, 5B and 5D. The bib retainer channel 18 receives the bib retainer 14*a* and a portion of the bib 12*a* adjacent the bib retainer 14*a* to releasably connect the bib 12*a* to the placemat 16*a*, as will be described in detail below with reference to FIGS. 7 and 8.

Figure 2A:
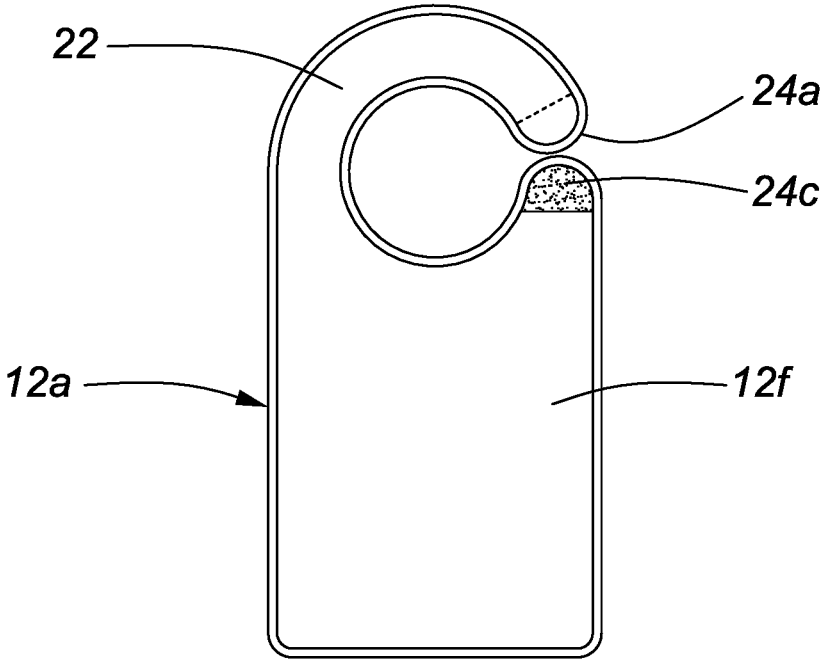
FIG. 2A is a front elevational view of the bib shown in FIG. 1.

FIG. 2A is a front elevational view of the bib 12*a* shown in FIG. 1. The bib 12*a* has and a neck strap 22. The neck strap 22 has a connector end 24*a* with a neck strap connector part 24*b* (see FIG. 2B) that connects to a neck strap second connector part 24*c*. In this embodiment the neck strap connector part 24*b* and the neck strap second connector part 24*c* are hook and loop fastener components. However, the neck strap connector parts 24*b*, 24*c* may be snap fastener pairs, a hook and eye pair, a magnetic pair, or any other convenient attachment system.

Figure 2B:
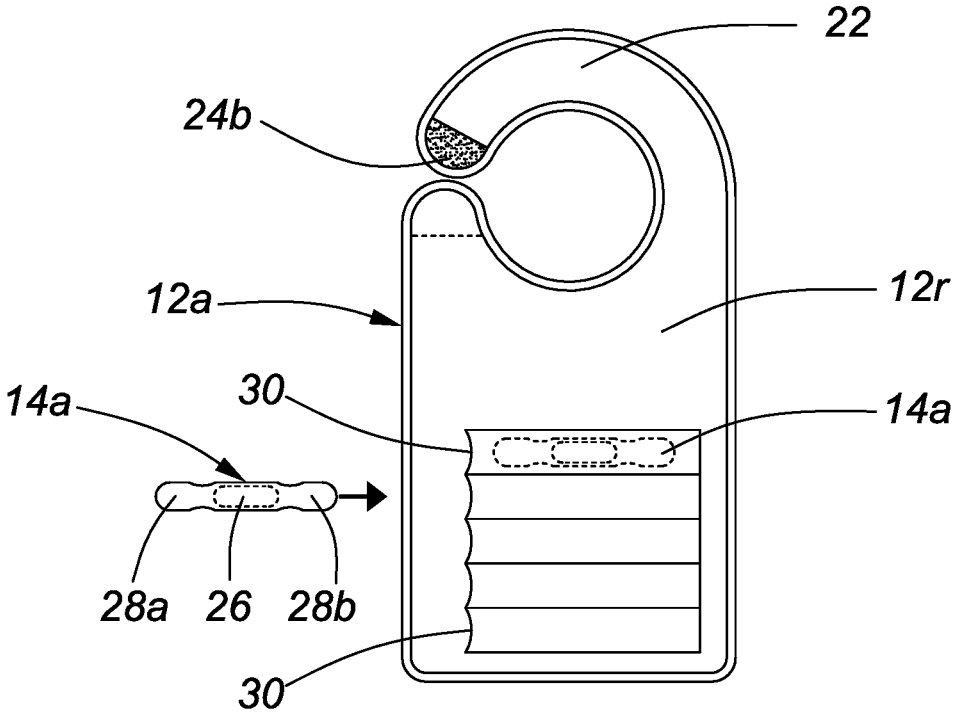
FIG. 2B is a rear elevational view of one embodiment of the bib shown in FIG. 1.

FIG. 2B is rear elevational view of the bib 12*a* shown in FIG. 1. The bib 12*a* has a rear surface 12*r* with a plurality of parallel bib retainer pockets 30. Each bib retainer pocket 30 is adapted to receive and retain the bib retainer 14*a* for releasably connecting the bib 12*a* to the placemat 16*a*. The bib retainer 14*a* fits snugly within each bib retainer pocket 30 so it does not readily fall out but the bib retainer 14*a* can be removed when it is desirable to relocate it to a different bib retainer pocket 30. The bib retainer 14*a* may be moved from one bib retainer pocket 30 to another bib retainer pocket 30 to adjust a length of the bib 12*a* above the placemat 16*a* to accommodate a height of a wearer, as will be explained below in more detail with reference to FIGS. 7 and 8. In one embodiment, the bib retainer 14*a* is molded from a flexible material, such as a silicone rubber formulation and has a bib retainer rigid core 26 (polyethylene in one embodiment or magnetic material in another embodiment, by way of example only) to lend rigidity to the central part of the bib retainer 14*a*, while permitting the respective ends 28*a* and 28*b* to flex. The flexible ends 28*a*, 28*b* permit a wearer of the bib 12*a* more freedom of movement without disconnecting the bib 12*a* from the placemat 16*a*.

Figure 3:
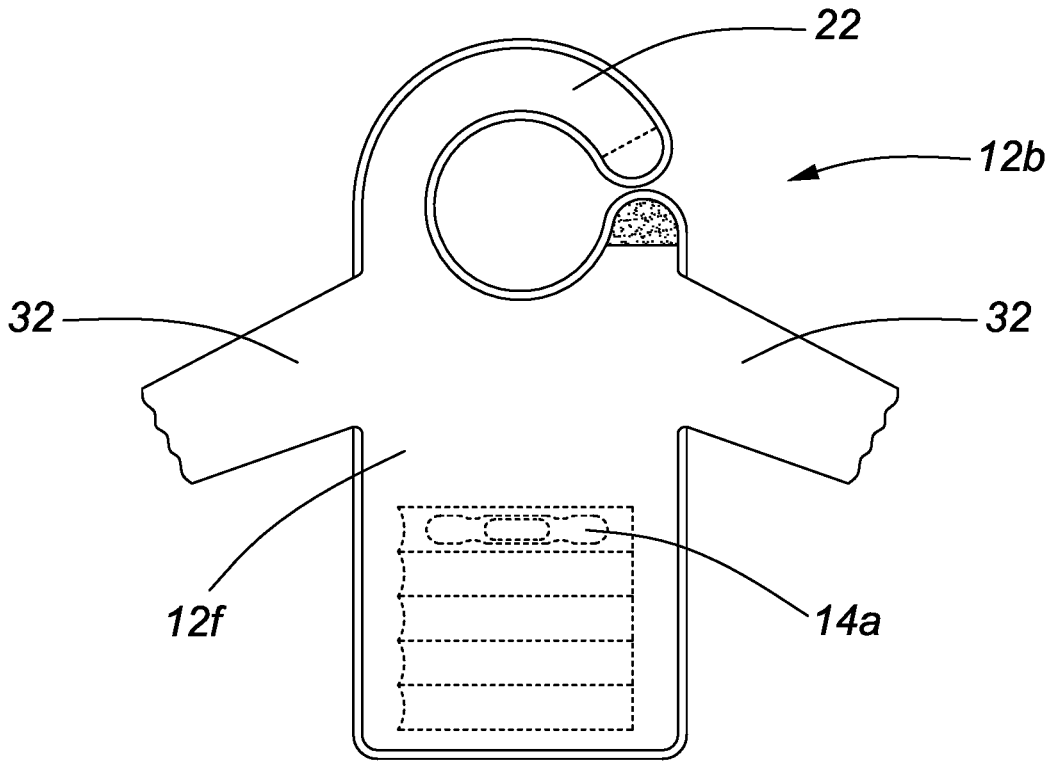
FIG. 3 is another embodiment of the bib for the asphyxiation-safe adjustable bib and placemat in accordance with the invention.

FIG. 3 is another embodiment of the bib 12*b* for the bib with bib retainer and placemat 10 in accordance with the invention. In this embodiment, the bib 12*b* includes bib garment sleeves 32 that cover the arms of a wearer to protect the wearer's arms from food spillage.

Figure 4A:
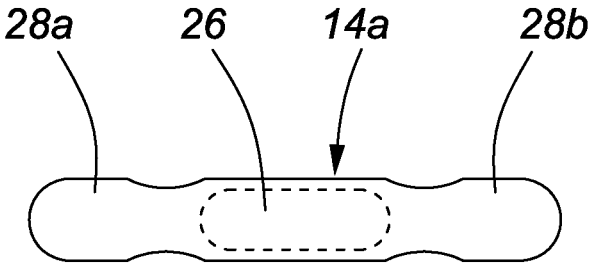
FIG. 4A is a top plan view of one embodiment of a bib retainer shown in FIG. 1.

FIG. 4A is top plan view of the bib retainer 14*a* shown in FIG. 1. As explained above, in one embodiment the bib retainer is molded from a resilient, flexible material such as a silicone rubber formulation. In one embodiment the bib retainer rigid core 26 is obround in plan and side elevational views. The bib retainer rigid core 26 makes the central part of the bib retainer 14*a* stiff and resistant to bending. In one embodiment, the flexibility of the opposed flexible ends 28*a*, and 28*b* is enhanced by a narrowing in width and thickness (see FIG. 4B) of the bib retainer 14*a* at opposite ends of the bib retainer rigid core 26.

Figure 4B:
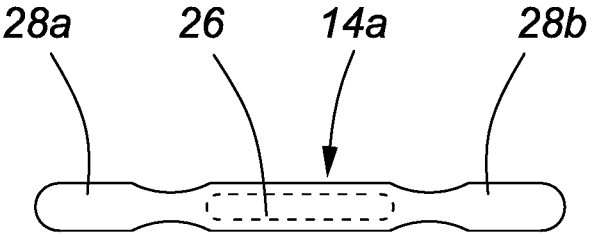
FIG. 4B is a side elevational view of the bib retainer shown in FIG. 5A.
Figure 7:
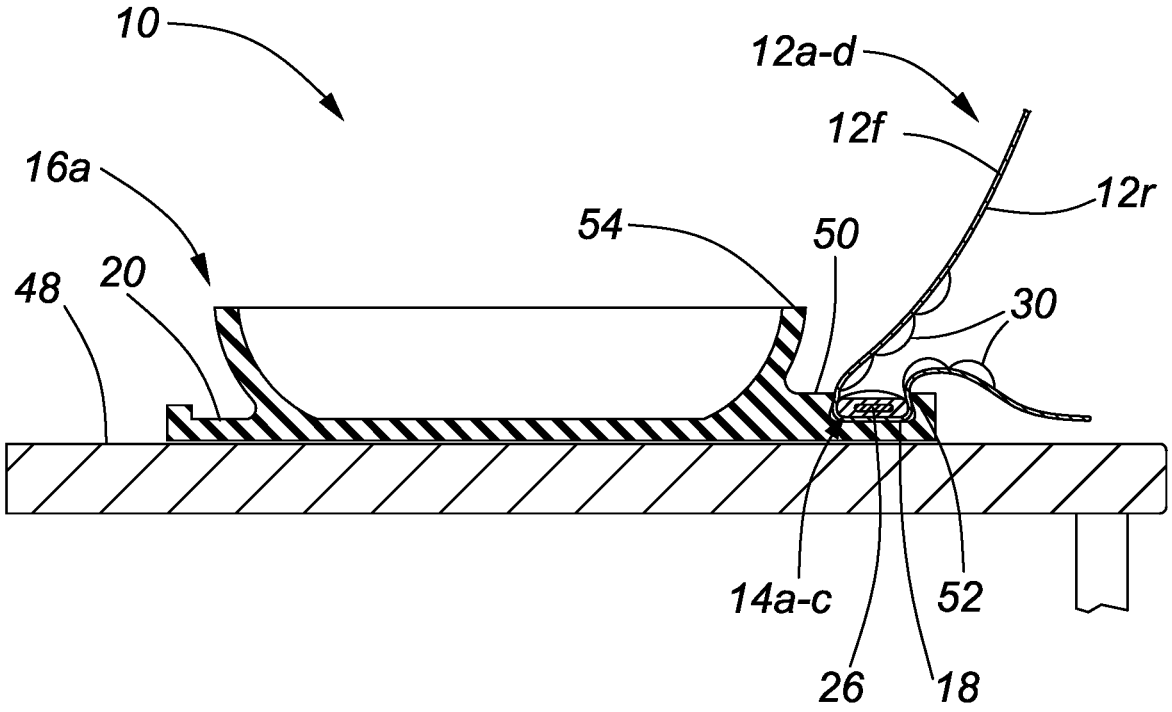
FIG. 7 is a cross-sectional view of the asphyxiation-safe adjustable bib and placemat taken along lines 7-7 of FIG. 6, illustrating how one embodiment of the bib is secured to the placemat.
Figure 8:
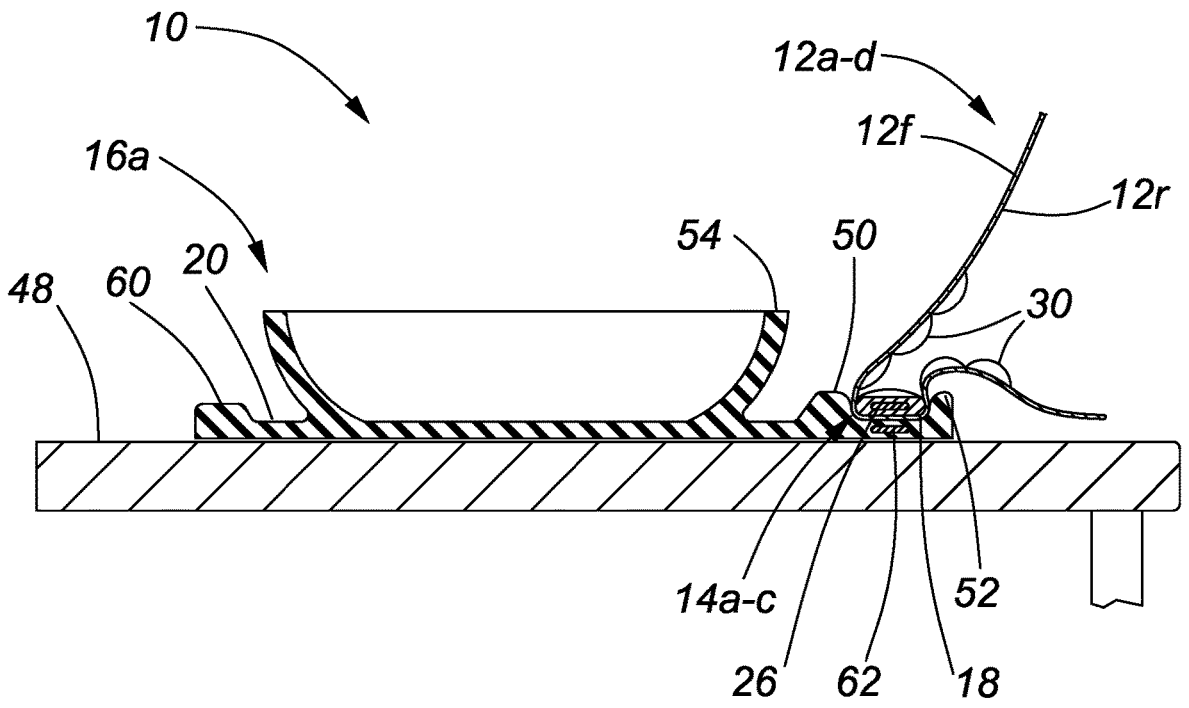
FIG. 8 is a cross-sectional view of the asphyxiation-safe adjustable bib and placemat taken along lines 7-7 of FIG. 6, illustrating an alternate embodiment for securement of the bib to the placemat in accordance with the invention.

FIG. 4B is side elevational view of the bib retainer 14*a* shown in FIG. 4A. As can be seen, in one embodiment the bib retainer 14*a* is wider than it is thick, so that it is obround in cross-section, as can be seen in FIGS. 7 and 8.

Figure 5A:
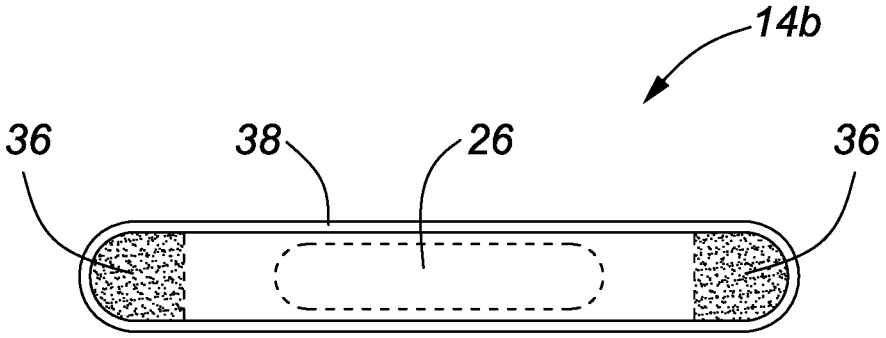
FIG. 5A is a top plan elevational view of another embodiment of a bib retainer in accordance with the invention.

FIG. 5A is rear elevational view of another embodiment of a bib retainer 14*b* in accordance with the invention. In this embodiment, the bib retainer 14*b* has a bib retainer rigid core 26 encased in an envelope of a durable fabric or molded plastic with a stitched or molded perimeter 38. Affixed to opposed ends of the bib retainer 14*b* are hook or loop fastener ends 36.

Figure 5B:
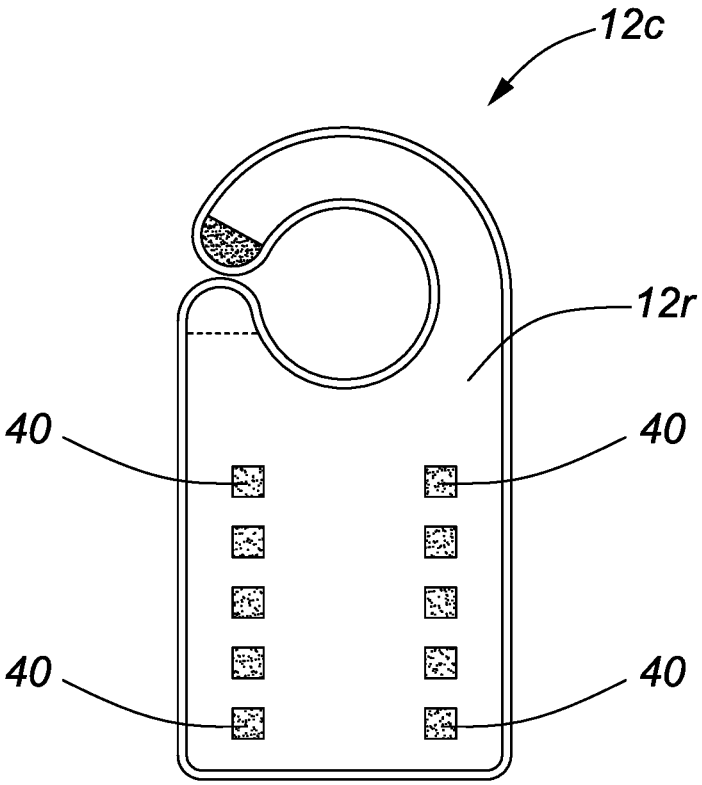
FIG. 5B is a rear elevational view of an embodiment of a bib for use with the bib retainer shown in FIG. 5A.

FIG. 5B is a rear elevational view of an embodiment of a bib 12*c* for use with the bib retainer 14*b* shown in FIG. 5A. In this embodiment the bib 12*c* has a plurality of pairs of hook or loop fastener attachment pairs 40 compatible with the respective hook or loop fastener ends 36 on the bib retainer 14*b*.

Figure 5C:
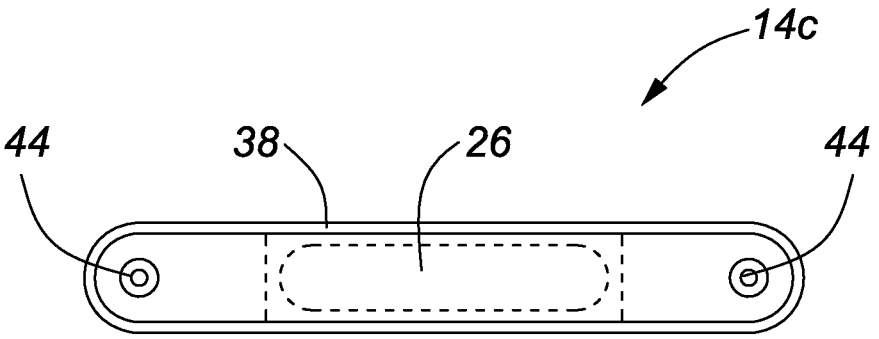
FIG. 5C is a side elevational view of further embodiment of a bib retainer in accordance with the invention.

FIG. 5C is rear elevational view of a further embodiment of a bib retainer 14*c* in accordance with the invention. The bib retainer 14*c* is similar to the bib retainer 14*b* described above with reference to FIGS. 5A and 5B except that the opposed ends are provided with snap fastener halves 44, well known in the art.

Figure 5D:
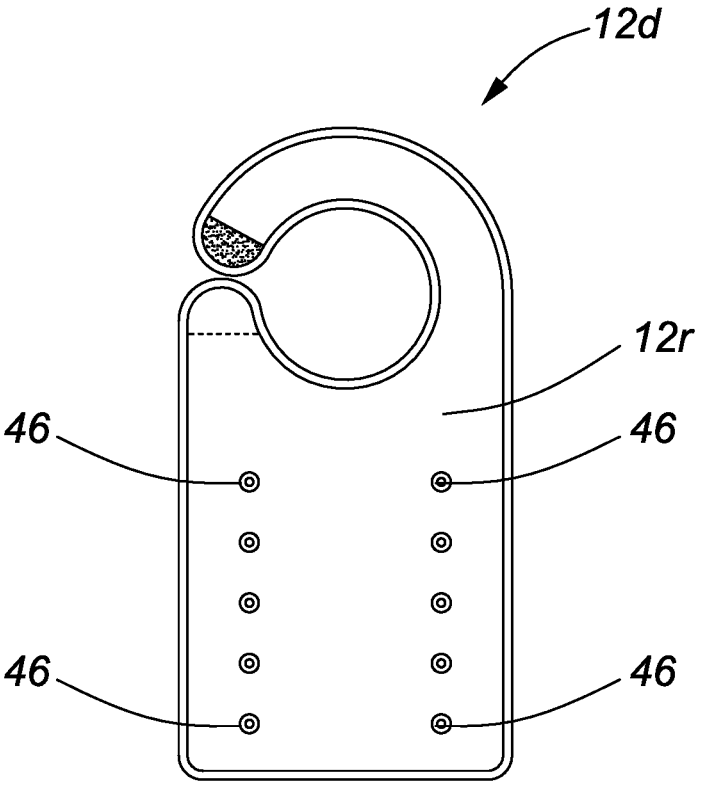
FIG. 5D is a rear elevational view of an embodiment of a bib for use with the bib retainer shown in FIG. 5C.

FIG. 5D is a rear elevational view of an embodiment of a bib 12*d* for use with the bib retainer 14*c* shown in FIG. 5C. A rear surface 12*r* of the bib 12*d* is provided with a plurality of pairs of compatible bib snap fastener halves 46 for attaching the bib retainer 14*c* to the bib 12*d*. The bib retainer snap fastener halves 44 may be male or female snap fastener halves, and the bib snap fastener halves 46 are compatible with the bib retainer snap fastener halves 44.

Figure 6:
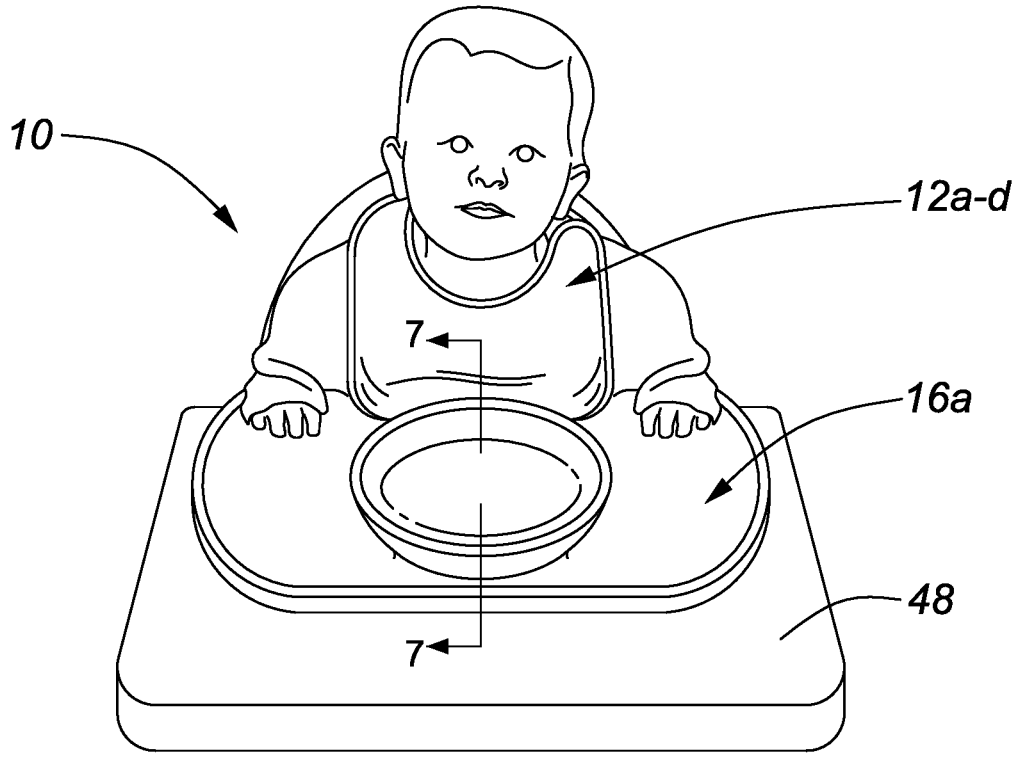
FIG. 6 is a perspective view of a baby using the asphyxiation-safe adjustable bibs with placemat shown in FIGS. 1-5D.

FIG. 6 a perspective view of a baby wearing the bib 12*a*-12*d* with placemat 16*a*. The bib 12*a*-12*d* is releasably connected to the placemat 16*a*, which is supported on a flat surface such as a table 48. In one embodiment, the placemat 16*a* has suction cups that secure it to the table 48, as will be explained below with reference to FIG. 9B.

FIG. 7 is a cross-sectional view of the bib with bib retainer and placemat 10 taken along lines 7-7 of FIG. 6, illustrating how the bibs 12*a*-12*d* are secured to the placemat 16*a*. Although bib 12*a* is illustrated, each bib 12*a*-12*d* is used and functions in a similar way. In this embodiment, the placemat 16*a* is provided with a front bib securement structure 50 and a rear bib securement structure 52 on opposite sides of the bib retainer channel 18. The bib retainer channel 18 receives the portion of the bib 12*a*-12*d* adjacent the bib retainer 14*a*-14*c*. As explained above, the bib retainer 14*a*-14*c* is in a selected position on the rear surface 12*r* of the bibs 12*a*-12*d*. For bibs 12*a* and 12*b*, the bib retainer 14*a* is inserted into a selected bib retainer pocket 30. For bibs 12*c* and 12*d* the bib retainer 14*b* and 14*c* are respectively connected to a connector pair on the rear surface 12*r* of the bibs 12*c* and 12*d*. As explained above, the position for the bib retainer 14*a*-14*c* on the rear surface 12*r* is selected to adjust a length of the bib 12*a*-12*d* above the placemat 16*a* to suit a height of a wearer. To connect the bib 12*a*-12*d* to the placemat 16*a*, the bib retainer 14*a*-14*c* and the portion of the bib 12*a*-12*d* adjacent the bib retainer 14*a*-14*c* are manually pressed downwardly into the bib retainer channel 18. When the bib retainer 14*a*-14*c* has been fully pressed into the bib retainer channel 18, the respective bib securement structures 50, 52 overhang top edges of the bib retainers 14*a*-14*c* at the bib retainer rigid core 26. The bib securement structures 50, 52 resist pull on the bib 12*a*-12*d* in any direction, so a wearer of the bib 12*a*-12*d* cannot readily detach the bib 12*a*-12*d* from the placemat 16*a*. However, if the wearer slides or falls from their seat and the bib 12*a*-12*d* is thus forcefully pulled away from the placemat 16*a*, the flexible rear bib securement structure 52 collapses rearwardly without undue resistance and releases the bib 12*a*-12*d* and the bib retainer 14*a*-*c* from the bib retainer channel 18, to obviate any possibility of injury due to asphyxiation.

FIG. 8 is a cross-sectional view of the bib with bib retainer and placemat 10 shown in FIG. 4, illustrating how the bib 12*a*-12*d*, is secured to another embodiment of the placemat 16*a*. In this embodiment, the placemat 16*a* is provided with a front bib securement structure 50 and a rear bib securement structure 52 on opposite sides of the bib retainer channel 18, but the bib retainer rigid core 26 of bib retainers 14*a*-14*c* is magnetic or contains embedded magnetic material having a magnetic pole(s) oriented to be strongly attracted to a bib retainer magnet(s) 62 embedded in the placemat 16*a* under the bib retainer channel 18. The magnetic attraction between the magnetic bib retainer 14*a*-14*c* and the bib retainer magnet(s) 62 resists pull on the bib 12*a*-12*d* in any direction, so a wearer cannot readily detach the bib 12*a*-12*d* from the placemat 16*a*. However, if the wearer slides or falls from a seat upon which the wearer is seated and the bib 12*a*-12*d* is pulled forcefully away from the placemat 16*a*, the leverage of the bib 12*a*-12*d* over the rear bib securement structure 52 tips the bib retainer 14*a*-14*c* on edge, which releases the bib 12*a*-12*d* and the bib retainer 14*a*-14*c* from the bib retainer channel 18 to obviate any possibility of injury due to asphyxiation.

Figure 9:
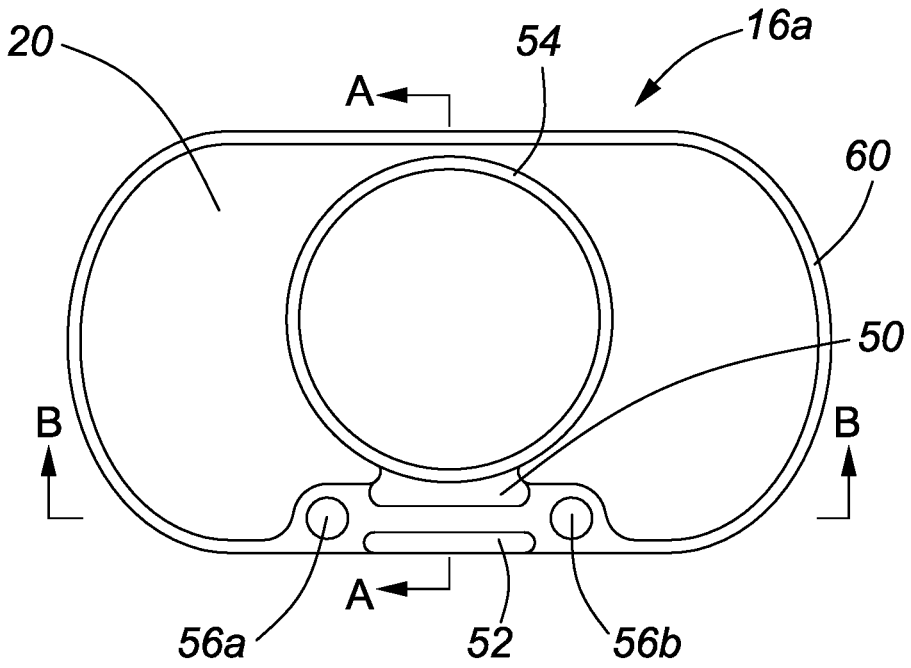
FIG. 9 is a top plan view of the placemat shown in FIG. 1.

FIG. 9 is top plan view of the placemat 16*a* with an integral food receptacle 54 in accordance with the invention. In this embodiment the food receptacle 54 is a bowl. The placemat 16*a* has a flat top surface 20 with an upstanding peripheral placemat rim 60 to retain any spillage from the food receptacle 54. In this embodiment, the front bib securement structure 50 is integral with a rear side of the food receptacle 54 and the rear bib securement structure is integral with the placemat rim 60. Located on opposite ends of the bib retainer channel 18 are respective "placemat suction buttons" 56*a*, 56*b* used to actuate placemat suction cups 58*a*, 58*b* (see FIG. 7B) that are optionally provided to further secure the placemat 16*a* to a smooth, flat surface such as the table 48.

Figure 9A:
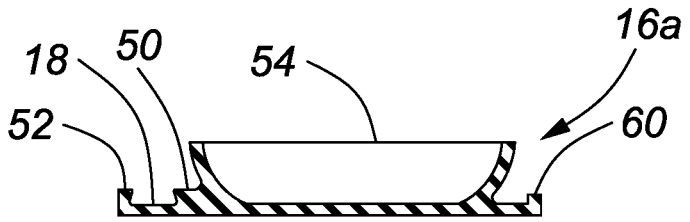
FIG. 9A is a cross-sectional view of the placemat shown in FIG. 9, taken along lines A-A of FIG. 9.

FIG. 9A is cross-sectional view of the placemat 16*a* taken along lines A-A of FIG. 9, illustrating the integration of the food receptacle 54 with the bottom of the placemat 16*a* and the integration of the front bib securement structure 50 with the rear side of the food receptacle 54.

Figure 9B:
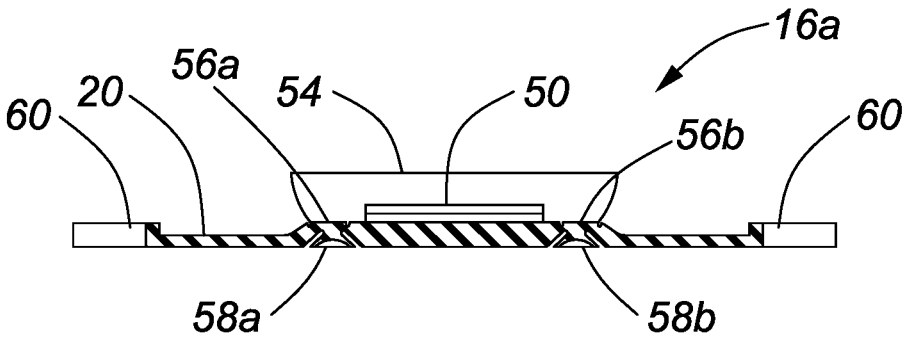
FIG. 9B is a cross-sectional view taken along lines B-B of FIG. 9.

FIG. 9B is cross-sectional view of the placemat 16*a* taken along lines B-B of FIG. 9. In this embodiment, the placemat 16*a* is provided with two optional placemat suction cups 58*a*, 58*b* located at opposed ends of the bib retainer channel 18. As described above, the respective placemat suction cups 58*a*, 58*b* are actuated by pressing of the respective placemat suction buttons 56*a*, 56*b*.

Figure 10:
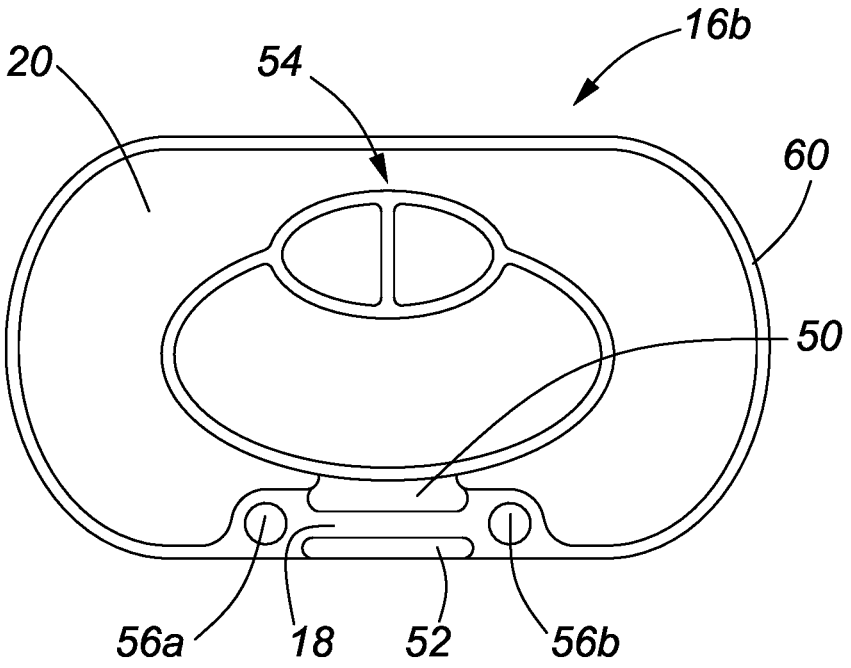
FIG. 10 is a top plan view of another embodiment of a placemat with an integral food receptacle in accordance with the invention.

FIG. 10 is top plan view of another embodiment of a placemat 16*b* with an integral food receptacle 54 in accordance with the invention. In this embodiment, the food receptacle is substantially oval and optionally partitioned into a plurality of food receptacle compartments. In other aspects, the placemat 16*b* is similar to the placemat 16*a* described above.

Figure 11:
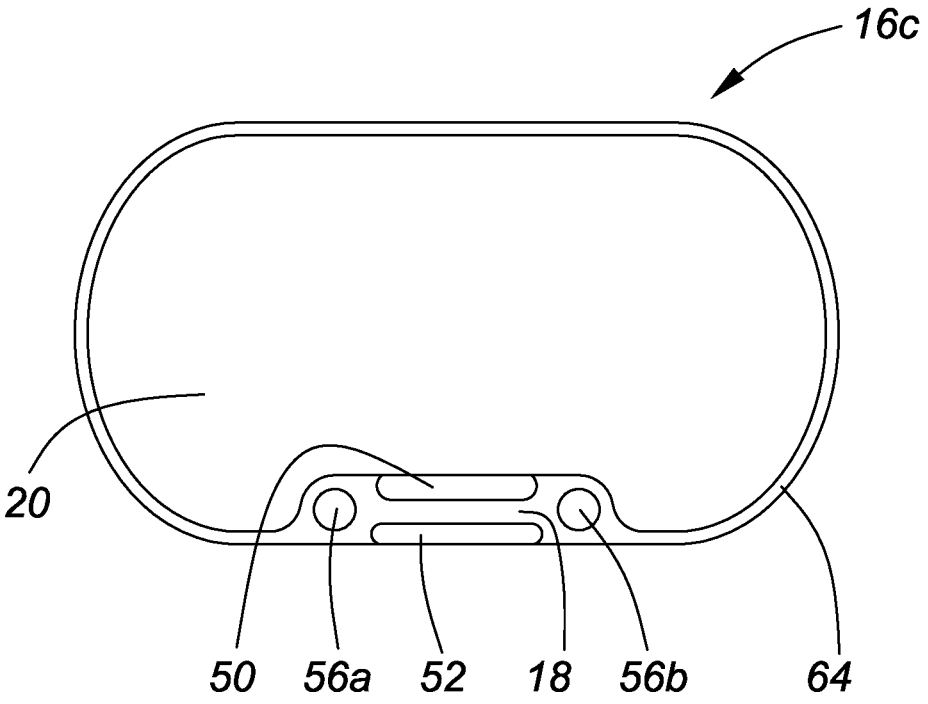
FIG. 11 is a top plan view of another embodiment of a placemat in accordance with the invention.

FIG. 11 is a top plan view of yet another embodiment of a placemat 16*c* in accordance with the invention. In this embodiment, the placemat 16*c* has a flat top surface 20 without a food receptacle. In all other respects, the placemat 16*c* is similar to the placemat 16*a* described above with reference to FIGS. 7-9B.

Figure 12:
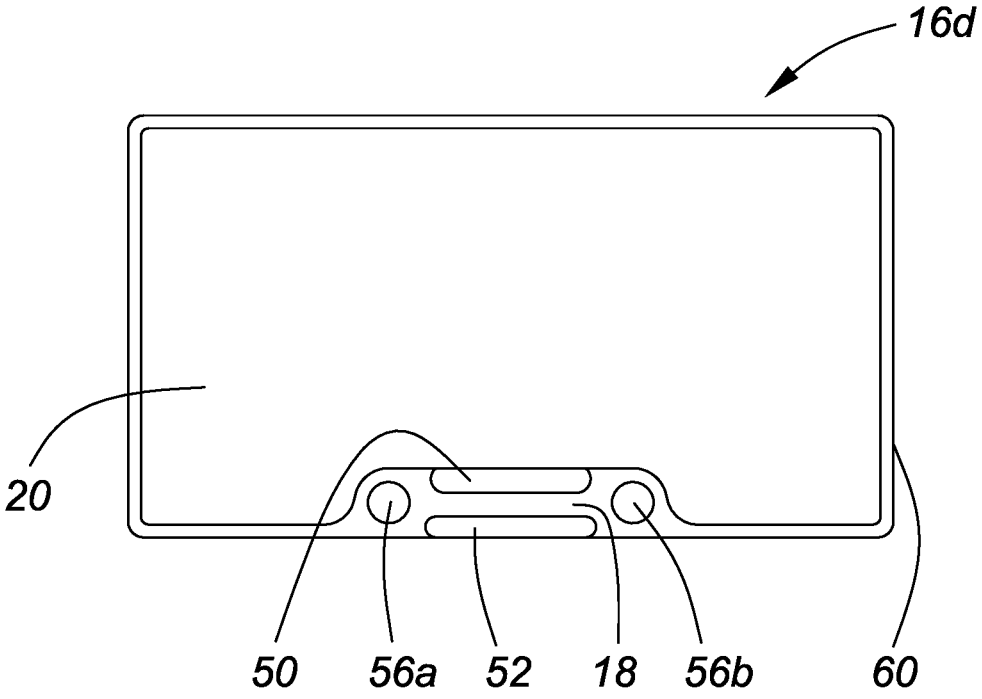
FIG. 12 is a top plan view of yet another embodiment of a placemat in accordance with the invention.

FIG. 12 is a top plan view of yet a further embodiment of a placemat 16*d* in accordance with the invention. In this embodiment, the placemat 16*d* has a flat top surface 20, is substantially square and has no food receptacle. However, the placemat 16*d* may be provided with an integral food receptacle, such as the food receptacles shown in FIG. 9 or FIG. 10, for example. In all other aspects, the placemat 16*d* is similar to the placemat 16*a* described above with reference to FIGS. 7-9B.

Although the invention has been described with reference to various embodiments, the description and the embodiments shown are exemplary only. The scope of the invention is therefore to be limited solely by the scope of the appended claims.

I claim:

1. An asphyxiation-safe adjustable bib with placemat, comprising in combination:

the placemat having a pliable peripheral rim with a bib retainer channel that extends along a portion of one inner side of the pliable peripheral rim; and the bib having a bib retainer removably affixed to any one of a plurality of parallel locations on a rear surface of the bib, the bib retainer being adapted to be received and retained, along with a portion of the bib adjacent the bib retainer, in the bib retainer channel and to resist movement of the bib to dislodge the bib and the bib retainer from the bib retainer channel.

2. The asphyxiation-safe adjustable bib with placemat as claimed in claim 1 wherein the bib retainer has a rigid central core.

3. The asphyxiation-safe adjustable bib with placemat as claimed in claim 2 further comprising a rear bib securement structure integral with the peripheral rim, the rear bib securement structure extending along a length of the bib retainer channel and a front bib securement structure that extends along a length of an opposite side of the bib retainer channel, the rear bib securement structure and the front bib securement structure respectively overhang top edges of the bib retainer when the bib retainer and the portion of the bob are inserted in the bib retainer channel.

4. The asphyxiation-safe adjustable bib with placemat as claimed in claim 2 wherein the rigid central core of the bib retainer is magnetic and has a magnetic pole that is strongly attracted to a bib retainer magnet embedded in the placemat under the bib retainer channel.

5. The asphyxiation-safe adjustable bib with placemat as claimed in claim 1 wherein the plurality of parallel locations on the rear surface of the bib comprise a plurality of parallel pockets adapted to respectively receive and removably retain the bib retainer.

6. The asphyxiation-safe adjustable bib with placemat as claimed in claim 1 wherein the plurality of parallel locations on the rear surface of the bib comprises a plurality of parallel fastener pairs and the bib retainer comprises a pair of compatible fasteners for connecting the bib retainer in any one pair of the plurality of fastener pairs.

7. The asphyxiation-safe adjustable bib as claimed in claim 6 wherein the fasteners comprise one of hook and loop fasteners and snap fasteners.

8. The asphyxiation-safe adjustable bib with placemat as claimed in claim 1 wherein the placemat further comprises an integral food receptacle.

9. The asphyxiation-safe adjustable bib with placemat as claimed in claim 8 wherein the integral food receptacle comprises a plurality of compartments.

10. The asphyxiation-safe adjustable bib with placemat as claimed in claim 1 wherein a bottom of the placemat further comprises integral placemat suction cups for securing the placemat to a smooth, flat surface.

11. The asphyxiation-safe adjustable bib with placemat as claimed in claim 10 wherein a toper surface of the placemat further comprises integral placemat suction buttons for actuating the placemat suction cups.

12. An asphyxiation-safe adjustable bib with placement, comprising in combination:

the placemat having a flat top surface with a pliable peripheral rim and a bib retainer channel that extends along a portion of an inner surface of the pliable peripheral rim; and the bib having a bib retainer made of a flexible material, the bib retainer having a rigid central core and a flexible end on each side of the rigid core, the bib retainer being removable affixed in one of a plurality of parallel positions on a rear surface of the bib, the bib retainer being adapted to be received and retained, along with a portion of the bib adjacent the bib retainer, in the bib retainer channel and to resist movement of the bib to dislodge the portion of the bib and the bib retainer from the bib retainer channel, but yield to a forceful movement of the bib to release the bib and the bib retainer from the bib retainer channel.

13. The asphyxiation-safe adjustable bib with placemat as claimed in claim 12 further comprising a front bib securement structure-along a side of the bib retainer channel spaced from the peripheral rim and a rear bib securement structure integral with the periheral rim opposite the front bib securement structure, the front bib securement structure and the rear bib securement structure overhanging top edges of the bib retainer when the portion of the bib and the bib retainer are inserted in the bib retainer channel.

14. The asphyxiation-safe adjustable bib with placemat as claimed in claim 12 wherein the rigid central core of the bib retainer is magnetic and has a magnetic pole that is strongly attracted to a bib retainer magnet embedded in the placemat under the bib retainer channel.

15. The asphyxiation-safe bib with placemat as claimed in claim 12 wherein the plurality of parallel locations on the rear surface of the bib comprises one of: a plurality of parallel pockets adapted to respectively receive and removably retain the bib retainer; a plurality of parallel fastener pairs and the bib retainer comprises pairs of compatible fasteners for connecting the bib retainer to any one pair of the plurality of fastener pairs.

16. The asphyxiation-safe adjustable bib as claimed in claim 15 wherein the fasteners comprise one of hook and loop fasteners and snap fasteners.

17. The asphyxiation-safe adjustable bib with placemat as claimed in claim 12 wherein the placemat further comprises an integral food receptacle.

18. The asphyxiation-safe adjustable bib with placemat as claimed in claim 12 wherein a bottom of the placemat further comprises integral placemat suction cups for securing the placemat to a smooth, flat surface and a top surface of the placemat further comprises integral placemat suction buttons for actuating the placemat suction cups.

19. An asphyxiation-safe adjustable bib with placemat, comprising in combination:

the placemat having a top surface with a pliable peripheral rim and a bib retainer channel that extends along a portion of an inner side of the pliable peripheral rim; and the bib having a bib retainer with pliable ends and a rigid central core between the pliable ends, the bib retainer being removably affixed in one of a plurality of parallel locations on a rear surface of the bib to permit a length of the bib between a neck strap of the bib and the bib retainer to be adjusted to accommodate a height of a bib wearer, the bib retainer being adapted to be received, along with a portion of the bib adjacent the bib retainer, in the bib retainer channel and to resist movement of the bib to dislodge the bib and the bib retainer from the bib retainer channel, but yield to forceful movement of the bib to release the bib and the bib retainer from the bib retainer channel.

20. The asphyxiation-safe adjustable bib with placemat as claimed in claim 19 wherein the placemat further comprises one of an integral food receptacle and an integral food receptacle that is partitioned into a plurality of compartments.

* * * * *